United States Patent [19]

Harrison

[11] 3,993,224

[45] Nov. 23, 1976

[54] SPOUT FOR TWO-COMPONENT RESIN DISPENSER

[75] Inventor: Stanley Harrison, Bedford, Mass.

[73] Assignee: Aerosol Investments, Ltd., Boston, Mass.

[22] Filed: Sept. 8, 1975

[21] Appl. No.: 611,220

[52] U.S. Cl. ..... 222/145
[51] Int. Cl.[2] ..... B67D 5/60
[58] Field of Search ..... 222/94, 541, 145

[56] References Cited

UNITED STATES PATENTS

| | | | |
|---|---|---|---|
| 2,349,962 | 5/1944 | Harris | 222/541 |
| 3,239,105 | 3/1966 | Woodson | 222/94 |
| 3,323,682 | 6/1967 | Creighton et al. | 222/94 |
| 3,416,709 | 12/1968 | Shultz et al. | 222/94 |

*Primary Examiner*—Allen N. Knowles
*Assistant Examiner*—Hadd Lane
*Attorney, Agent, or Firm*—Kenway & Jenney

[57] ABSTRACT

In the two-component resin dispenser construction disclosed herein, an elongate spout is employed which provides a pair of parallel channels for conducting the respective resin components. The spout is of uniform cross-sectional configuration and is constructed of a readily severable material so that the distal end of the spout may be repeatedly cut off to clear the dispenser of plugs formed by the resin.

2 Claims, 4 Drawing Figures

SPOUT FOR TWO-COMPONENT RESIN DISPENSER

BACKGROUND OF THE INVENTION

This invention relates to a spout or outlet structure for a two-component resin dispenser and, more particularly, to such a spout which permits the dispenser to be readily cleared of plugs formed by the resin.

Two-component resins, i.e. resins which harden or solidify when the two components thereof come into contact, find wide application in a variety of uses. For best results, the components of such resins are preferably mixed in predetermined volumetric ratio and various dispensing mechanisms have been devised for co-dispensing the components in the desired ratio. A particularly useful form of dispenser is disclosed in U.S. Pat. No. 3,813,011 issued to Stanley Harrison and Jeffrey M. Feldman on May 28, 1974, for an Aerosol Can For Dispensing Materials In Fixed Volumetric Ratio. In dispensing materials of this character, however, one continuing problem has been the tendency of the valve or outlet structure of the dispenser to clog as the result of contact between the resin components at the point where they are being ejected from the dispenser. Various solutions for overcoming this problem have been suggested, including separate plugs for the respective outlet ports and self-cleaning nozzle structures such as that disclosed in the aforementioned '011 patent.

Among the several objects of the present invention, may be noted the provision of a dispenser for a two-component resin having an outlet structure which may be easily cleared of plugs formed by the resin; the provision of such a dispenser which does not interfere with the release of the components from the dispenser, the provision of such a dispenser which allows the components to be dispensed in close proximity to each other; the provision of such dispenser which is highly reliable and which is of relatively simple and inexpensive construction. Other objects and features will be in part apparent and in part pointed out hereinafter.

SUMMARY OF THE INVENTION

Briefly, the present invention relates to a pressurized dispenser for a two-component resin which hardens when the two components come into contact, the dispenser having a valve structure providing a pair of ports through which the respective components are dispensed. In accordance with the invention, the dispenser includes an elongate spout coupled to the valve structure, the spout being of constant cross-sectional shape and dimensions and having a pair of parallel longitudinal channels therein. Each of the channels communicates, at the proximal end of the spout, with a respective one of the ports. The spout is constructed of a material which is easily severable. Accordingly, the distal end of the spout may be repeatedly cut off to clear the dispenser of plugs formed by the resin.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
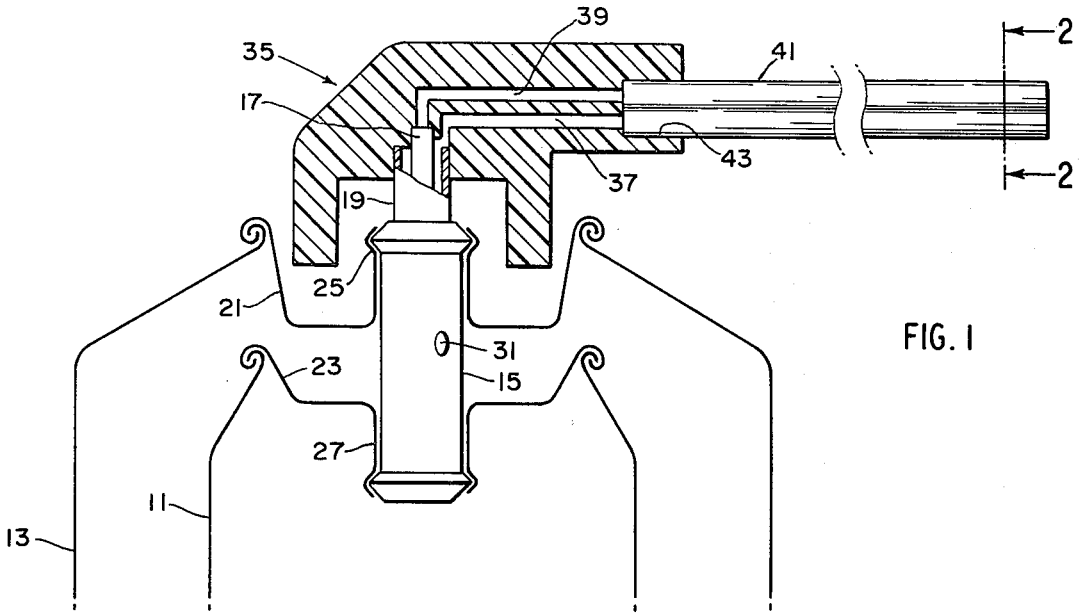
FIG. 1 is a cross-sectional side view of a pressurized dispenser for a two-component resin, having an outlet structure in accordance with the present invention.

Referring now to FIG. 1, there is illustrated a pressurized dispenser of the general type disclosed in U.S. Pat. No. 3,813,011, the dispenser includes an inner cylindrical container 11 mounted concentrically within an outer cylindrical container or can 13. Conventional covers 21 and 23 are crimped on to the respective cylindrical can cylinders 11 and 13 in accordance with standard practice. A concentric flow, dual aerosol valve purchased from Precision Valve Company of Yonkers, New York, is installed within a generally cylindrical aluminum coupling member 15, the inner outlet tube of the valve assembly being indicated at 17 and the outer outlet tube being indicated at 19. The upper end of the aluminum coupling member 15 is crimped into an upwardly extending cylindrical portion of the cover 21 as indicated at 25 while the lower end of the coupling 15 is crimped into a similar, but downwardly extending, portion of the cover 23 as indicated at 27. A suitable port 31 is provided in the coupling member 15 for admitting the chemical component from the compartment between the two can cylinders 11 and 13 to the outer portion of the coaxial valve assembly.

As described in the previously identified patent, the inner and outer compartments provided by the can cylinders 11 and 13 may be filled with respective components of a two-component chemical system, e.g. as epoxy resin. A coaxial piston (not shown) is biased upwardly by a suitable propellent gas, so as to displace the components in fixed volumetric ratio when the coaxial valve is opened. The two-port cap provided with the coaxial valve assembly is indicated at 35. As may be seen, this cap couples the flow from the outer channel of the coaxial valve to an outlet port 37 and couples the flow from the inner outlet of the coaxial valve to an outlet port 39, the outlet ports being closely adjacent. In accordance with the practice of the present invention, a plastic straw 41 of figure-eight shaped cross-section is inserted in a counter-bore 43 so that each of the longitudinal channels in the straw is aligned with and abuts a respective one of the ports 37 or 39. Accordingly, the longitudinal channels provided by the straw act as continuations of the ports 37 and 39, permitting the resin components to be dispensed in close proximity to each other. Straw 41 is press fit or cemented in place.

As will be understood by those skilled in the art, straws of the type shown at 41 are available in a variety of sizes and with minor cross-sectional variations and such straws are commonly sold as drink stirrers. Further, such straws are typically constructed from materials that are easily cut such as PVC, polyethelene, etc. Thus, although a clot of hardened resin may form at the closely adjacent outlet channels at the distal end of the straw, this clot or plug may be readily removed so as to clear the channels by merely cutting off the tip of the straw, e.g. with scissors. Further, by providing a straw of even moderate length, such a clot may be repeatedly cleared from the end of the dispenser outlet without so shortening the straw that the components cannot be dispensed at a selected location.

As distinguished from the more usual form of severable spout, i.e., a spout which is initially cut off to open an outlet or is cut so as to provide an opening of selectable size, the elongate spout of the present invention has a cross-section which is constant in configuration and dimension over its significant length and thus this spout may be distinguished from these prior art constructions which were conceived for entirely different purposes.

The spout of the present invention may also advantageously be utilized with disposable mixing element, e.g., the Kenics mixer or that disclosed in U.S. Pat. No. 3,159,312. The old mixing element may be cut off with the tip of the spout and replaced with a new element.

Figure 2:
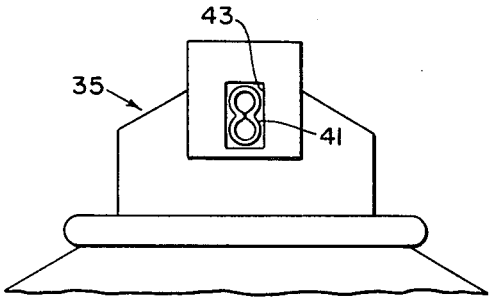
FIG. 2 is an end-on view of the outlet of the dispenser taken substantially on the line 2—2 of FIG. 1.
Figure 4:
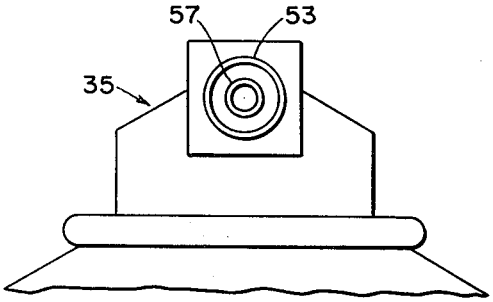
FIG. 4 is an end-on view taken substantially on the line 4—4 of FIG. 3.
Figure 3:
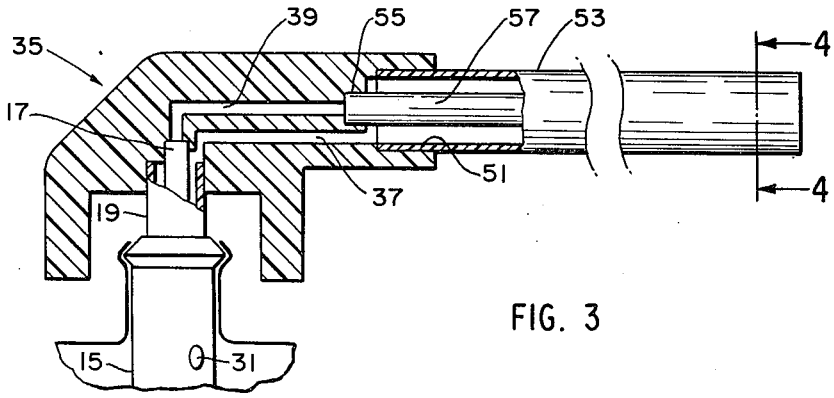
FIG. 3 is a cross-sectional view of a dispenser employing another embodiment of the outlet structure of the present invention.

While the figure-eight cross-section illustrated in FIGS. 1 and 2 is the presently preferred means of providing an elongate spout having parallel longitudinal channels, concentric straws may also be utilized, i.e., as illustrated in FIGS. 3 and 4. With reference to FIG. 3, the cap 35 is counter-bored as indicated at 51 so as to receive an outer straw 53 of circular cross-section, which straw communicates with outlet 37. A deeper counter-bore bond, indicated at 55, receives a smaller diameter straw 57, also of circular cross-section. The counter bore 55 is located so that the concentric inner channel provided by the straw communicates with the outlet 39. Again, the straws 53 and 57 are constructed of a material which is readily cut. Accordingly, such clots which may occur at the distal end of the overall outlet structure may be readily cleared by cutting off the tips of these straws.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a pressurized dispenser for a two-component resin which hardens when the two components come into contact, said dispenser having a valve structure providing a pair of ports through which the respective resin components are dispensed, the improvement comprising an elongate spout coupled to said valve structure, said spout being in the nature of a plastic straw of constant cross-sectional shape generally in the form of a figure-eight providing a pair of parallel, side-by-side longitudinal channels, the portions of the material of the straw forming the respective side-by-side channels being joined at a nexus between the channels, each of said channels being in communication with, at the proximal end of said spout, a respective one of said ports, said spout being of substantial length and being constructed of a material which is easily severable, whereby the distal end of said spout may be repeatedly cut off to clear the dispenser of plugs formed of said resin.

2. In a pressurized dispenser for a two-component resin which hardens when the two components come into contact, said dispenser having a valve structure providing a pair of ports through which the respective resin components are dispensed, the improvement comprising an elongate spout coupled to said valve structure, said spout being of constant cross-sectional shape and dimension and having a pair of parallel longitudinal channels therein each of which communicates, at the proximal end of said spout, with a respective one of said ports, said spout comprising a pair of concentric plastic straws, each having a generally circular cross-sectional shape and being constructed of a material which is easily severable, whereby the distal end of said spout may be repeatedly cut off to clear the dispenser of plugs formed of said resin.

* * * * *